US012788209B2

(12) United States Patent
Cardano et al.

(10) Patent No.: US 12,788,209 B2
(45) **Date of Patent: *Nov. 10, 2026**

(54) MOVEABLE SHELF ASSEMBLY FOR A DISHWASHER

(71) Applicant: WHIRLPOOL CORPORATION, Benton Harbor, MI (US)

(72) Inventors: Fabio Cardano, Galliate (IT); Joseph Thomas Ferencevich, Saint Joseph, MI (US); Umit Can Koralay, Milan (IT); Mateusz Uzniak, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/039,992

(22) Filed: Jan. 29, 2025

(65) Prior Publication Data

US 2025/0185877 A1 Jun. 12, 2025

Related U.S. Application Data

(63) Continuation of application No. 18/135,427, filed on Apr. 17, 2023, now Pat. No. 12,232,682.

(51) Int. Cl.
*A47L 15/50* (2006.01)

(52) U.S. Cl.
CPC ..... *A47L 15/504* (2013.01); *A47L 15/502* (2013.01); *A47L 15/507* (2013.01)

(58) Field of Classification Search
CPC .... A47L 15/504; A47L 15/503; A47L 15/502; A47L 15/507
See application file for complete search history.

(56) References Cited

U.S. PATENT DOCUMENTS

| | | | | |
|---|---|---|---|---|
| 3,752,322 | A | 8/1973 | Fiocca et al. | |
| 4,927,033 | A * | 5/1990 | Patera | A47L 15/505 211/41.9 |
| 5,480,035 | A * | 1/1996 | Smith | A47L 15/503 211/168 |
| 6,848,585 | B2 | 2/2005 | VanLandingham | |
| 7,424,893 | B2 | 9/2008 | Kim | |
| 7,644,826 | B2 | 1/2010 | Koch et al. | |
| 7,766,175 | B2 | 8/2010 | Jadhav et al. | |
| 7,775,378 | B2 | 8/2010 | Tynes et al. | |
| 7,931,155 | B2 * | 4/2011 | Bastuji | A47L 15/503 211/41.9 |
| 8,042,559 | B2 * | 10/2011 | Choi | B08B 3/04 211/41.9 |
| 8,567,882 | B1 | 10/2013 | Garnett | |

(Continued)

FOREIGN PATENT DOCUMENTS

| | | | |
|---|---|---|---|
| DE | 102019216603 | A1 | 4/2021 |
| EP | 1925251 | B1 | 11/2009 |
| EP | 2074925 | B1 | 12/2010 |

*Primary Examiner* — Ko H Chan
(74) *Attorney, Agent, or Firm* — Price Heneveld LLP

(57) ABSTRACT

A moveable shelf assembly is used within a dish treating appliance. The moveable shelf assembly includes a retaining body having at least one attachment arm. The at least one attachment arm is configured to be coupled to a dish rack. The moveable shelf assembly also includes a planar shelf body extending along a width. The planar shelf body is operably coupled to the retaining body for rotation between a storage position and a use position.

19 Claims, 10 Drawing Sheets

(56) References Cited

U.S. PATENT DOCUMENTS

| | | | | |
|---|---|---|---|---|
| 8,651,287 | B2 | 2/2014 | Moser et al. | |
| 8,701,898 | B2 | 4/2014 | Chai | |
| 8,757,419 | B2 * | 6/2014 | Schessl | A47L 15/503 220/489 |
| 9,033,432 | B2 | 5/2015 | Kilic et al. | |
| 9,131,828 | B2 | 9/2015 | Yoon et al. | |
| 9,579,009 | B2 | 2/2017 | Bhajak et al. | |
| 9,615,722 | B2 | 4/2017 | Mesa et al. | |
| 10,022,037 | B2 | 7/2018 | Kutto et al. | |
| 10,136,795 | B2 | 11/2018 | Nowell, Jr. et al. | |
| 10,165,927 | B2 | 1/2019 | Mesa et al. | |
| 10,228,185 | B2 | 3/2019 | Cizik et al. | |
| 10,405,731 | B2 | 9/2019 | Harr | |
| 10,463,226 | B2 | 11/2019 | Mesa et al. | |
| 10,582,829 | B2 | 3/2020 | Hansen et al. | |
| 10,602,909 | B2 | 3/2020 | Gupta et al. | |
| 10,945,585 | B2 | 3/2021 | Mohite et al. | |
| 11,006,814 | B1 * | 5/2021 | Simmonds | A47L 15/505 |
| 11,167,883 | B1 * | 11/2021 | Schuldt | B65D 25/06 |
| 11,317,740 | B2 * | 5/2022 | Roberts | A47B 57/581 |
| 11,369,250 | B2 * | 6/2022 | Lam | F16B 2/14 |
| 11,612,300 | B2 * | 3/2023 | Harr | A47L 15/505 211/41.8 |
| 11,766,161 | B2 * | 9/2023 | Held | A47L 15/503 211/74 |
| 11,826,004 | B2 * | 11/2023 | Reiter | A47L 15/503 |
| 2005/0109378 | A1 * | 5/2005 | Landsiedel | A47L 15/14 134/179 |
| 2005/0133469 | A1 | 6/2005 | Mersch et al. | |
| 2006/0254627 | A1 | 11/2006 | Lim | |
| 2007/0039904 | A1 | 2/2007 | Purushothaman | |
| 2007/0131696 | A1 | 6/2007 | Schessl et al. | |
| 2011/0018410 | A1 | 1/2011 | Bastuji et al. | |
| 2017/0266703 | A1 | 9/2017 | Borghi et al. | |
| 2020/0268229 | A1 | 8/2020 | Koska et al. | |
| 2021/0244258 | A1 | 8/2021 | Elkhoury et al. | |
| 2022/0409007 | A1 * | 12/2022 | Renz | A47L 15/505 |
| 2023/0157517 | A1 * | 5/2023 | Kim | A47L 15/507 211/41.8 |
| 2023/0248207 | A1 | 8/2023 | Persson et al. | |
| 2023/0329520 | A1 * | 10/2023 | Garnett | A47L 15/504 |

* cited by examiner

MOVEABLE SHELF ASSEMBLY FOR A DISHWASHER

CROSS-REFERENCE TO RELATED APPLICATION(S)

This application is a continuation of U.S. patent application Ser. No. 18/135,427, filed on Apr. 17, 2023, now U.S. U.S. Pat. No. 12,232,682, issued Feb. 25, 2025, which is hereby incorporated herein by reference in its entirety.

BACKGROUND

Contemporary automatic dish treating appliances for use in a typical household include a cabinet with an access opening and a tub that can have an open front and at least partially defines a treating chamber into which items, such as kitchenware, glassware, and the like, can be placed to undergo a treating operation, such as washing. A spraying system with multiple sprayers can be provided for recirculating liquid throughout the tub to remove soils from the dishes. The dishwasher can be further provided with a door assembly, which can be hingedly mounted to the tub or to the cabinet for pivoting movement about a pivot axis between closed and opened positions to selectively close and open the open front and the access opening.

BRIEF DESCRIPTION

An aspect of the present disclosure relates to a moveable shelf assembly comprising a retaining body having at least one attachment arm configured to be coupled to a dish rack, and a planar shelf body extending along a width and operably coupled to the retaining body for rotation between a storage position wherein the shelf body is upright and a use position wherein the shelf body is at least partially lowered, wherein the shelf body includes first and second positioning cross bars extending along the width and configured to allow for vertical movement of the shelf body along the retaining body between at least a lower use position and an upper use position.

Another aspect of the disclosure is a retrofit kit for a dish treating appliance, the retrofit kit comprising a moveable shelf assembly, comprising a retaining body having at least one attachment arm configured to be coupled to a dish rack, and a planar shelf body extending along a width and operably coupled to the retaining body for rotation between a storage position wherein the shelf body is upright and a use position wherein the shelf body is at least partially lowered, wherein the shelf body includes first and second positioning cross bars extending along the width and configured to allow for vertical movement of the shelf body along the retaining body between at least a lower use position and an upper use position.

DETAILED DESCRIPTION

Generally, at least one rack or basket for supporting soiled dishes can be provided within the tub. The at least one rack or basket can be provided in the form of upper and lower dish racks. A silverware or utensil basket for holding utensils, silverware, cutlery, and the like, may also be provided and is generally removably mounted to the door assembly or within one of the dish racks. The dish racks can further include at least one shelf that can be provided in a variety of configurations within the dish racks for supporting soiled dishes.

In order to provide more flexibility to users for customized or specific supports for dish items of various sizes and shapes, at least one moveable shelf assembly can be included with at least one of the dish racks to provide support for dish items for treatment in a specific treating cycle of operation or for a specific type of dish items loaded into the dish treating appliance. In some cases, a user may desire to be able to adjust or customize the dish rack supports for accommodating specific dish items or types of dish items. By including a moveable shelf assembly that can be adjusted to more than one position for supporting dish items, greater flexibility is provided to the user. Further, even in dish treating appliances with dish racks that may not initially include such moveable shelf assemblies, if a moveable shelf assembly can be provided as a standalone kit that can be added to a wide variety of dish racks and dish treating appliances, to add customizability to dish racks that would not otherwise have it, the scope of the benefits that can be realized is even wider. In this manner, the moveable shelf assembly can retrofit an existing dish rack with additional capabilities and provide improved user experiences.

Aspects of the present disclosure relate to a moveable shelf assembly for use with various dish racks of various dish treating appliances. The moveable shelf assembly includes, among other things, a shelf assembly that is simple and easy to operate, has reduced cost and part counts, and does not interfere with other dish racks. The moveable shelf assembly can be a retrofit assembly that is added to existing appliances or can be included as sold. Thus, the moveable shelf assembly can be suitable for any manner of applications including that of the household dish treating appliance of FIG. 1, which is illustrated by way of example and not limitation.

Figure 1:
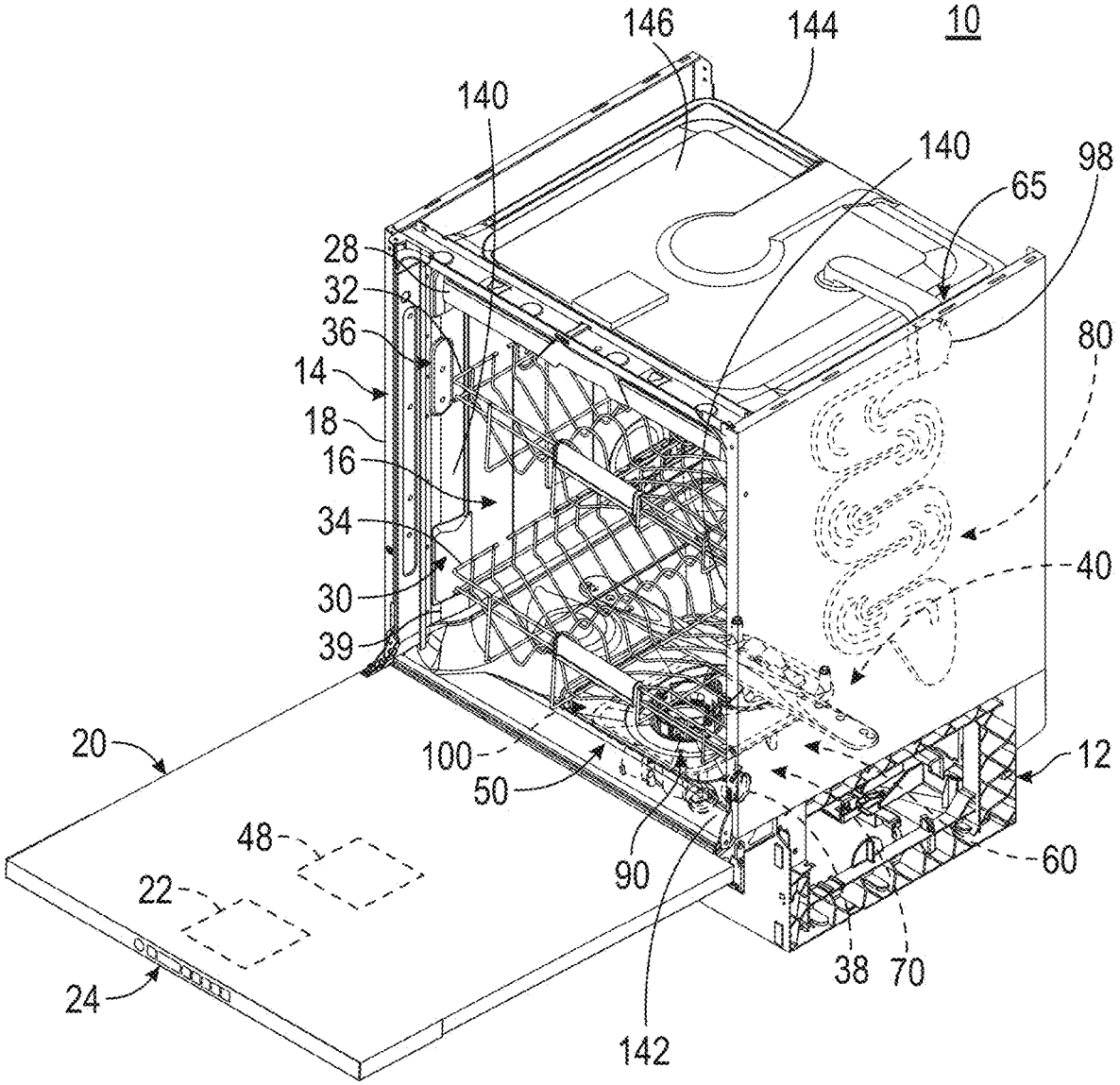
FIG. 1 is a top, front, and right-side perspective view of an automatic dish treating appliance having multiple systems for implementing an automatic cycle of operation.

FIG. 1 illustrates an automatic dish treating appliance 10, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher 10 implementation, which is designed for mounting under a countertop or other work surface. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis or cabinet is provided to support the variety of systems needed to implement the automatic cycle of operation and can define an interior. As illustrated, for a built-in implementation, the chassis or cabinet includes a frame in the form of a base 12 on which is supported an open-faced tub 14, which at least partially defines a treating chamber 16, having an access opening, illustrated herein as an open face 18, for receiving the dishes. The open-faced tub 14 can have at least a pair of opposing side walls 140 that are spaced apart from one another, such as by being spaced apart by a bottom wall 142, a rear wall 144, and/or a top wall 146. The pair of opposing side walls 140, the bottom wall 142, the rear wall 144, and the top wall 146 can further be thought of as at least partially defining the treating chamber 16, and optionally also the open face 18 to serve as the access opening.

A closure in the form of a door assembly 20 can be hingedly or pivotally mounted to the base 12, or to any other suitable portion of the cabinet or chassis or of the tub 14, for movement relative to the tub 14 between opened and closed positions to selectively open and close the open face 18 of the tub 14. In one example, the door assembly 20 is mounted for pivoting movement about a pivot axis relative to the base 12, the tub 14, or the open face 18. In the opened position, a user can 4cess the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items.

The chassis or cabinet, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, air supply system 65, heating system 90, and filter system 100. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22. While the user interface 24 is illustrated in FIG. 1 as being provided on a top surface of the door assembly 20, it will be understood that the user interface 24 can be provided at any suitable location on the door assembly 20, such as on a front surface of the door assembly 20.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure or structures for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. In one example, it is common for the upper dish rack 32 to be slidably mounted within and to the tub 14 by the use of a suitable drawer withdrawal assembly, such as by the use of drawer guides, slides, or rails 36, while the lower dish rack 34 is instead typically provided with wheels or rollers 38 that can roll along a travel path 39 defined by at least a portion of the dishwasher 10. For example, it is typical for the lower dish rack 34 to be slidable along the travel path 39 such that the lower dish rack 34 can roll along the travel path 39 and then continue to roll onto the door assembly 20, when the door assembly 20 is in the opened position and allows for withdrawal of the dish racks 32, 34.

By way of further example, in such a case, it is also typical that the travel path 39 can include a type of rails (not shown), but that such rails for the travel path 39 of the lower dish rack 34 may differ in structure from the rails 36 for the upper dish rack 32, and in particular such that the travel path 39 may be provided simply as a ledge or a surface formed by the tub 14, such as formed or carried by the side walls 140 or the bottom wall 142 of the tub 14. By providing the travel path 39 for the lower dish rack 34 as a simpler support surface, such as a ledge, rather than a more restrictive or enclosing structure such as the rails 36, the travel path 39 is better able to accommodate movement or instability of the lower dish rack 34 as the lower dish rack 34 rolls onto the door assembly 20, going from the static, stable tub 14 to the movable door assembly 20. In this way, the travel path 39 allows more tolerance for movement as the lower dish rack 34 rolls along the door assembly 20.

In addition, dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
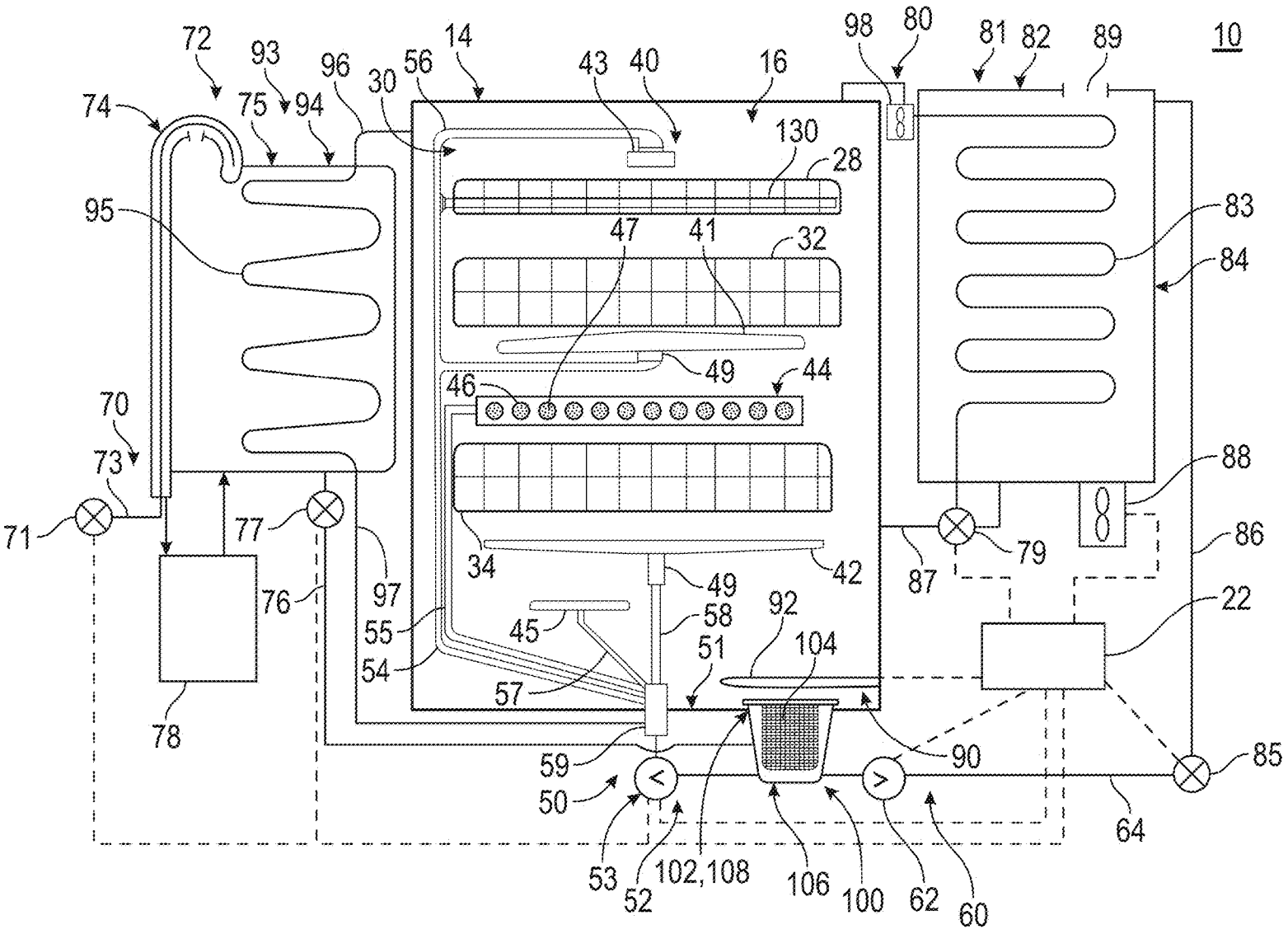
FIG. 2 is a schematic view of the dish treating appliance of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. In one non-limiting example, at least one drive assembly, illustrated herein as at least one motor 49, is operably coupled to one of or to each of the upper spray arm 41 and the lower spray arm 42 in order to control and drive rotation of the lower spray arm 42. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish racks 28, 32, 34 wherein deep cleaning is desired.

The spot sprayer 45, like the deep-clean sprayer 44, can emit an intensified and/or higher pressure spray, especially to a discrete location within one of the dish racks 28, 32, 34. While the spot sprayer 45 is shown below the lower dish rack 34, it could be adjacent any part of any dish rack 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish racks 28, 32, 34. The recirculation system 50 can include a sump 51 and a pump assembly 52. The sump 51 collects the liquid sprayed in the treating chamber 16 and can be formed by a sloped or recess portion of the bottom wall 142 of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break or an air break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

An air supply system 65 is provided to aid in the treating of the dishes during the cycle of operation by supplying air to at least a portion of the dishwasher 10, a non-limiting example of which includes the treating chamber 16. The air supply system 65 can include a variety of assemblies, pathways, and circuits for supplying air to different portions of the dishwasher 10 and for different purposes within the dishwasher 10, such that the air supply system 65 can be thought of as comprising all of the air supplying or air circulating portions of the dishwasher 10. In one non-limiting example, the air supply system 65 comprises a drying system 80 that is provided to aid in the drying of the dishes during the drying phase. The drying system 80 as illustrated, by way of non-limiting example, includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber 16, or a combination of both by operating in one configuration and then the other configuration. A fan or blower 98 can be fluidly coupled with the serpentine conduit 83 to move air through the serpentine conduit 83. It will also be understood that the serpentine conduit 83 is not limited to having a serpentine shape and can instead be provided with any suitable size and shape.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
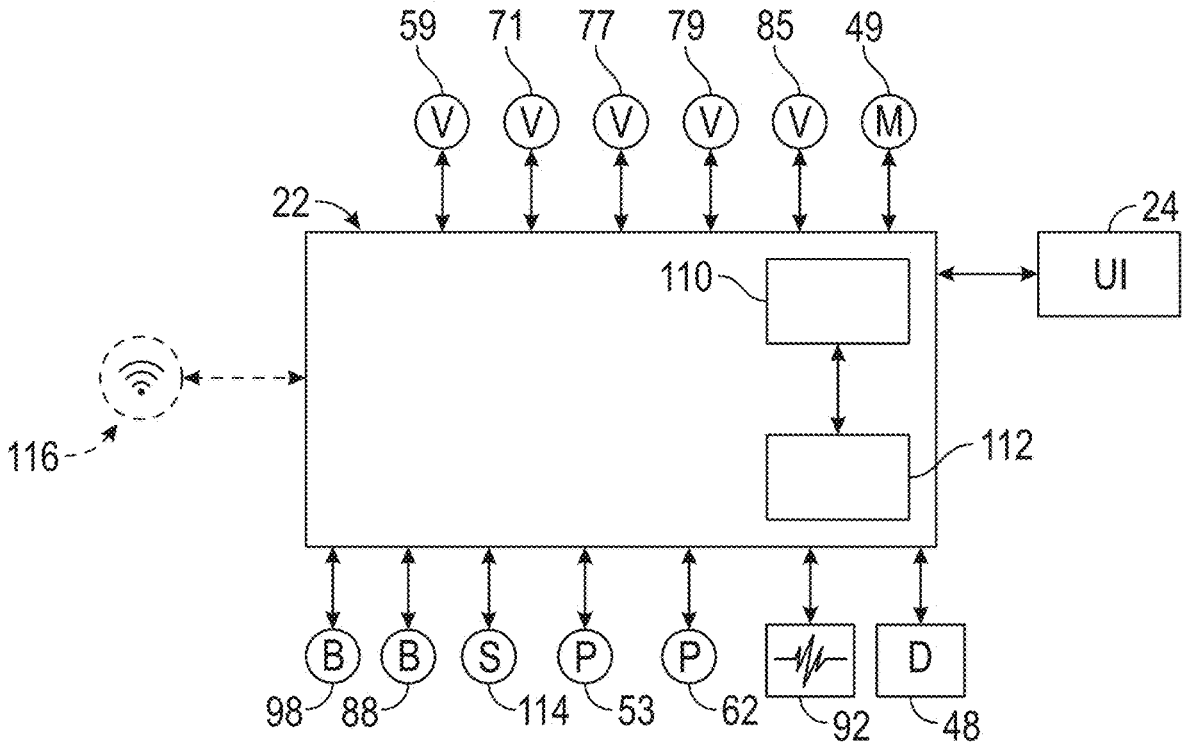
FIG. 3 is a schematic view of a controller of the dish treating appliance of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, the dispenser assembly 48 for selectively dispensing treating chemistry to the treating chamber 16, the at least one motor 49 for selectively actuating rotation of the upper spray arm 41 and/or the lower spray arm 42, the blower 98 for providing air through the serpentine conduit 83, and the blower 88 for providing air into the cooling tank 84. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
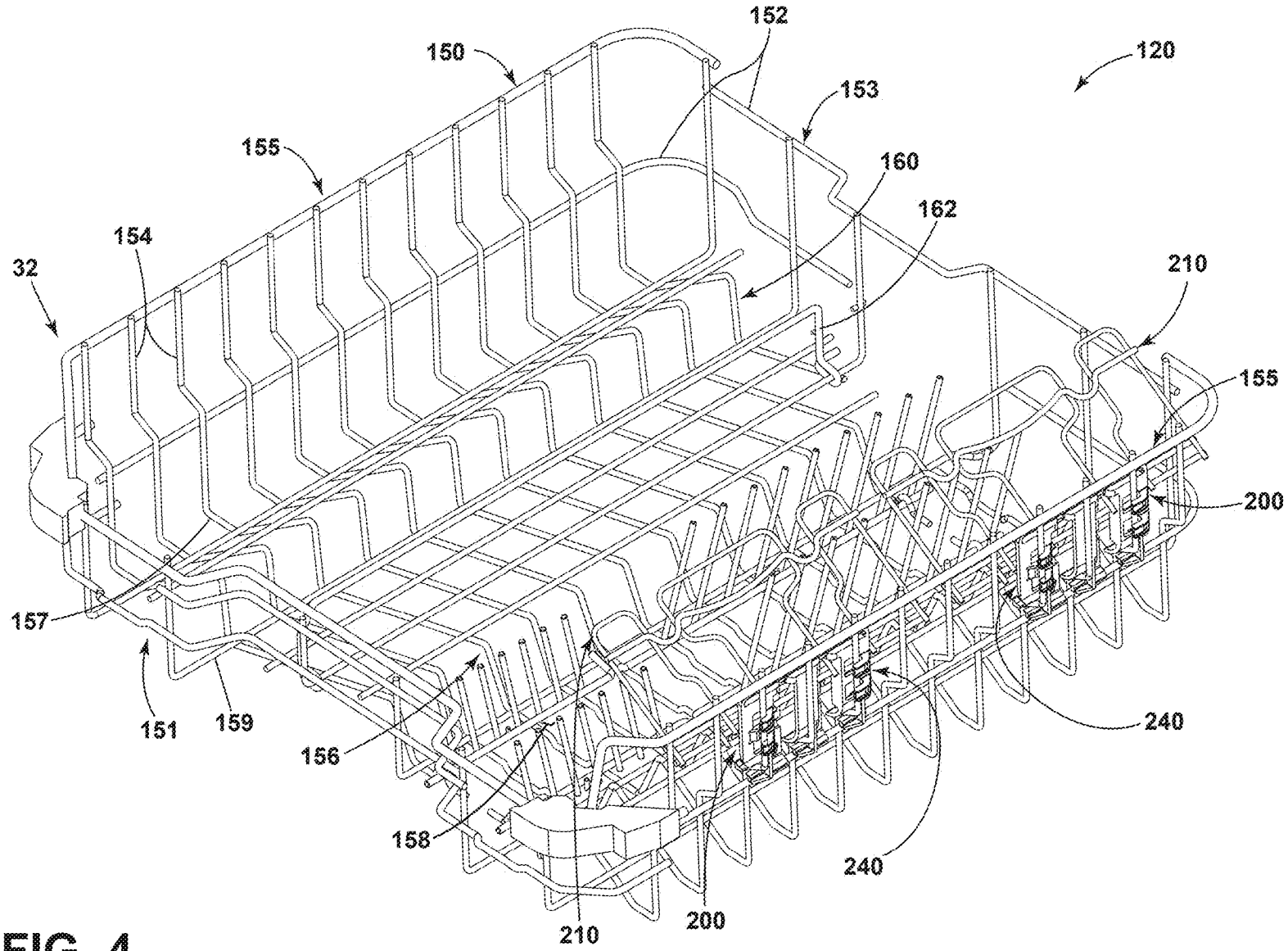
FIG. 4 illustrates a top perspective view of a dish rack assembly with a moveable shelf assembly shown in a use position and including a shelf body and a retaining member, according to an aspect of the present disclosure and for use with the dish treating appliance of FIGS. 1-3.

Turning now to FIG. 4, a perspective view of a dish rack assembly 120 comprising the upper dish rack 32 is illustrated. It will be understood that the third level rack 28, the upper dish rack 32, and lower dish rack 34 can be formed in any suitable manner and are not limited to the illustrated shapes and structures. In the illustrated example, a perimeter wall 150, comprising a plurality of cross members 152 and vertical members 154, extending upwardly from a bottom wall, shown as a floor latticework 156, to define an interior 158 of the upper dish rack 32. The perimeter wall 150 can be thought of as comprising a front wall 151, a rear wall 153, and opposing side walls 155. The floor latticework 156 comprises intersecting first members 157 and second members 159. While the first members 157 are illustrated herein as extending across a width of the upper dish rack 32 and the second members 159 are illustrated herein as extending across a length or depth of the upper dish rack 32, it will be understood that these orientations are not limiting. The floor latticework 156 can further define contoured portions 160 of the floor latticework 156 that can extend upwardly or downwardly to aid in positioning the various shapes and sizes of dishes within the upper dish rack 32, though it will be understood that the floor latticework 156 can have a constant profile or can have a varied profile comprising any combination of inclined, curved, or flat sections or pluralities of such sections. Further still, a plurality of positioning supports 162, such as panels, tines, or other structures, can extend upwardly from the floor latticework 156 into the interior 158 to aid in positioning of dish items.

Figure 9:
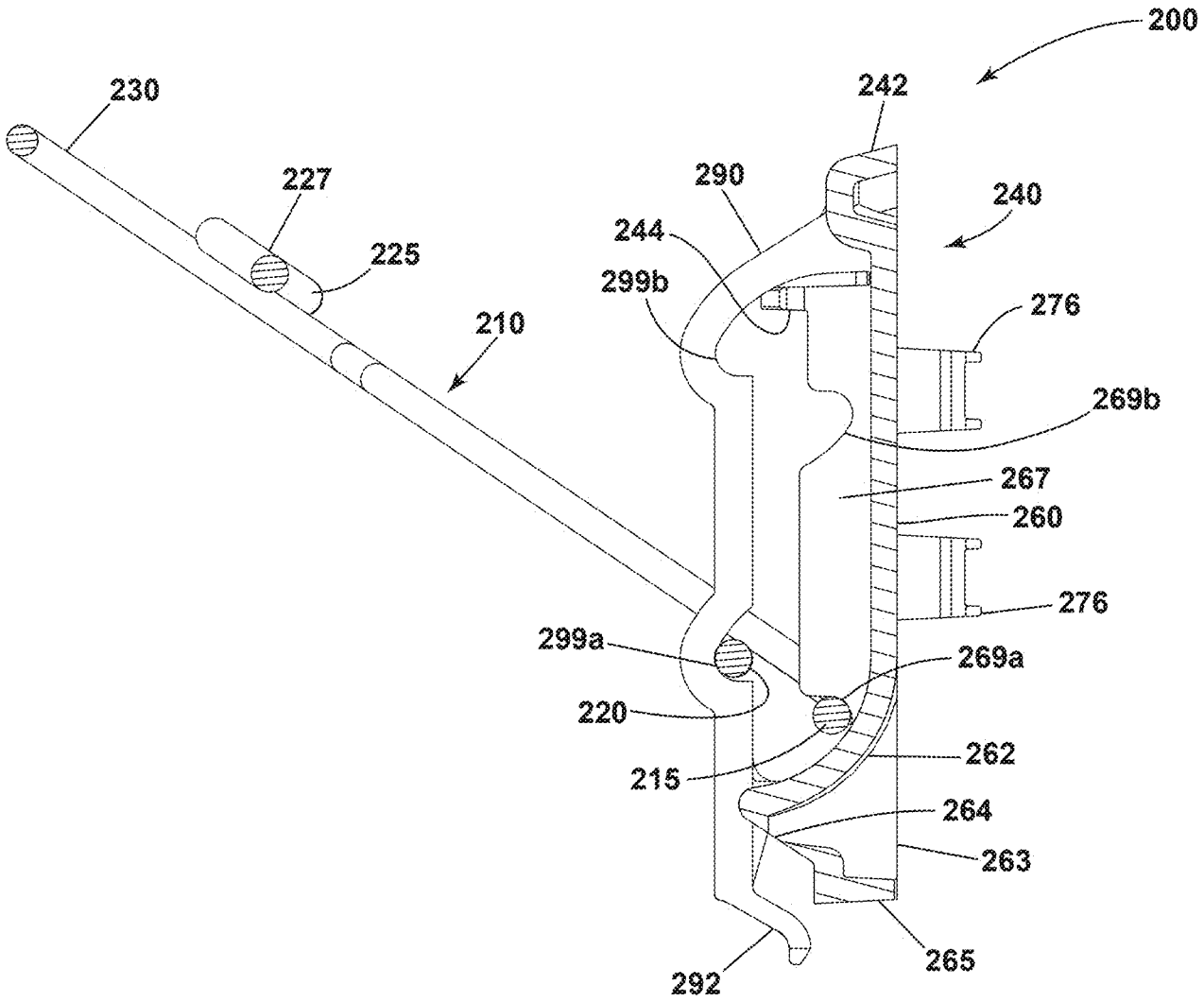
FIG. 9 illustrates the front cross-sectional view of the moveable shelf assembly of FIG. 8, with the shelf body shown in a second, or lower, use position.

At least one moveable shelf assembly 200 can be included located within the interior 158 of the dish rack assembly 120. In the illustrated example, two moveable shelf assemblies 200 are included. The moveable shelf assembly 200 comprises a shelf body 210 moveably coupled to a retaining member 240 for movement between at least a use position, as shown, and a storage position (FIG. 9). The shelf body 210 is operably coupled to the retaining member 240 and is configured for movement such as sliding, pivoting, or rotating between the upright or stowed storage position (FIG. 9) and one or more use positions, as shown, that can be thought of as being at least partially folded down relative to the storage position. As used herein, "folded down" refers to a position of the shelf body 210 that is more horizontal than the upright, storage position, such that dish items placed on the shelf body 210 will not be dislodged by gravity or by a spraying liquid, up to and including a fully horizontal position. The shelf body 210 can be operably coupled with the retaining member 240 in such a manner that the shelf body 210 can be vertically adjusted between one or more vertical positions.

The retaining member 240 is coupled to a portion of the perimeter wall 150 to attach the moveable shelf assembly 200 to the upper dish rack 32. While the moveable shelf assembly 200 is illustrated as being coupled to the side wall 155 of the upper dish rack 32, it will be understood that the moveable shelf assembly 200 can be provided at any suitable location within the upper dish rack 32, including on the front wall 151, the rear wall 153, or the alternate side wall 155. The moveable shelf assembly 200 can extend along at least a portion of a length of the corresponding one of the walls 151, 153, 155 forming the perimeter wall 150. In the illustrated example, the moveable shelf assembly 200 extends along approximately half of the side wall 155, though it is contemplated that the movable shelf assembly 200 could extend along any suitable portion of length of any of the walls 151, 153, 155 including a full length of the wall.

In the illustrated example, the dish rack assembly 120 includes two moveable shelf assemblies 200 provided along the length of the side wall 155 in succession along a length of the side wall 155. The two moveable shelf assemblies 200 can be positioned and moveable or adjustable independently of one another. While the dish rack assembly 120 is illustrated herein as including two moveable shelf assemblies 200, it will be understood that the dish rack assembly 120 can include any suitable number of moveable shelf assemblies 200, including a single moveable shelf assembly 200. Further, in the case that more than one moveable shelf assembly 200 is included with the dish rack assembly 120, multiple moveable shelf assemblies 200 can be provided on a single wall 151, 153, 155, or one moveable shelf assembly 200 can be provided on multiple separate walls 151, 153, 155. Further still, at least one moveable shelf assembly 200 can be located on one of the opposing side walls 155, while another moveable shelf assembly 200 is located on the other of the opposing side walls 155. Further still, depending on the height positioning of the moveable shelf assemblies 200, two can be positioned on adjacent walls about a corner.

While only the upper dish rack 32 is illustrated herein as including the moveable shelf assembly 200, it will be understood that either or both of the upper dish rack 32 or the lower dish rack 34 can include the at least one moveable shelf assembly 200. Further, it will be understood that the dishwasher 10 can also include a combination of fixed and moveable shelf assemblies 200, or that all of the shelf assemblies 200 within the dishwasher 10 can be provided as movable shelf assemblies 200. Further still, at least one moveable shelf assembly 200 can be provided within the upper dish rack 32 or the lower rack 34, or both. Further, it will be understood that the moveable shelf assembly 200 can be utilized with any suitable dish rack assembly, including that it can be retrofit into a previously existing dish rack assembly.

Figure 5:
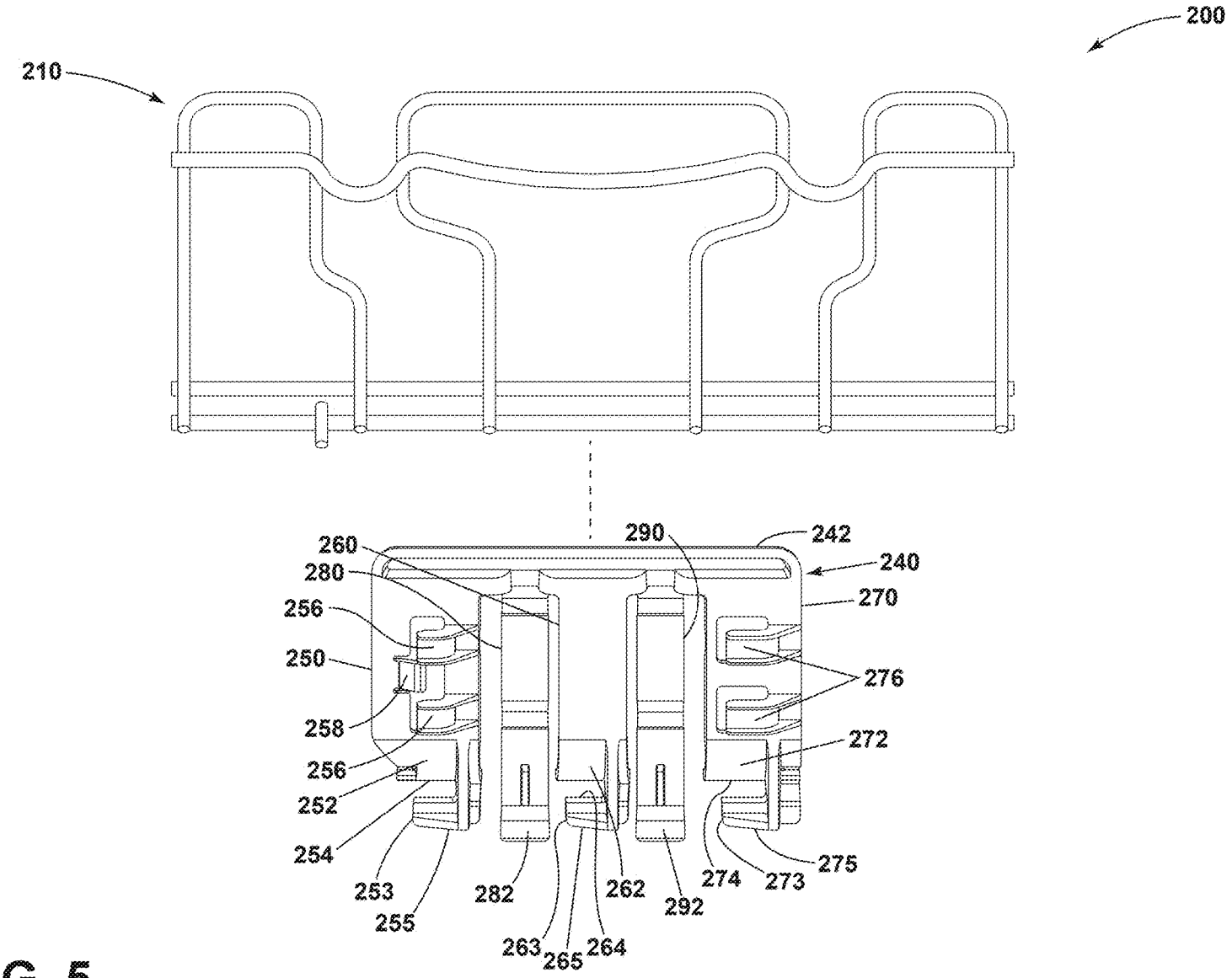
FIG. 5 illustrates an exploded rear perspective view of the moveable shelf assembly of FIG. 4, shown with the shelf body in the use position and with the dish rack assembly removed.

Turning now to the exploded rear view of the moveable shelf assembly 200 illustrated in FIG. 5, the moveable shelf assembly 200 is shown with the dish rack assembly 120 removed to better show the detail of the retaining member 240. The retaining member 240 comprises a retaining body 242 defining a width of the retaining member 240 configured for coupling with both the shelf body 210 and with the side wall 155 (FIG. 4). Specifically, the retaining member 240 further comprises a first attachment arm 250, a second attachment arm 260, and a third attachment arm 270 each extending downwardly from the body 242 and configured for attachment with one of the vertical members 154 (FIG. 4). Each of the first, second, and third attachment arms 250, 260, 270 extends downwardly away from the body 242 to define a lower curved end 252, 262, 272 that curves laterally inward from the first, second, and third attachment arms 250, 260, 270 toward or into the interior 158 (FIG. 4).

Each of the first, second, and third attachment arms 250, 260, 270 further includes a foot, illustrated herein as a guide flange 253, 263, 273, extending further downwardly and laterally outward from the lower curved ends 252, 262, 272 to define lowermost edges 255, 265, 275 of the first, second, and third attachment arms 250, 260, 270 spaced from and opposite the body 242. The guide flanges 253, 263, 273, together with the lower curved ends 252, 262, 272, at least partially define guide slots 254, 264, 274 within which a portion of the side wall 155 can be received.

At least one of the first, second, and third attachment arms 250, 260, 270 can include additional features for attachment to the vertical members 154. In the illustrated example, each of the first and third attachment arms 250, 270 further comprise at least one mounting clip 256, 276, illustrated herein as comprising a pair of mounting clips 256, 276, extending laterally outward from the first and third attachment arms 250, 270, away from the interior 158 (FIG. 4), and configured for coupling with the adjacent vertical member 154. The first attachment arm 250 is further illustrated as including at least one opposing clip 258 extending laterally outward from the first attachment arm 250, away from the interior 158 (FIG. 4), and configured for coupling with the opposite side of the adjacent vertical member 154 from the mounting clips 256. It will be understood that such layouts of the mounting clips 256, 276 and the opposing clip 258 are not limiting and that any of the first, second, and third attachment arms 250, 260, 270 can include any suitable distribution of mounting clips 256, 276 and opposing clips 258.

The retaining member 240 further yet comprises first and second retaining arms 280, 290 each extending downwardly from the body 242 and configured for coupling with the shelf body 210 and with the side wall 155. Each of the first and second retaining arms 280, 290 extends downwardly away from the body 242 to define a lower retaining end 282, 292 spaced from and opposite the body 242 and that extends laterally outward from the first and second retaining arms 280, 290, away from the interior 158 (FIG. 4), to align with or engage with the side wall 155.

As illustrated, the first and third attachment arms 250, 270 are spaced apart from one another and provided at opposing ends of the body 242, with the second attachment arm 260 being provided in between the first and third attachment arms 250, 270, approximately at a midpoint of the body 242. The first and second retaining arms 280, 290 can be interposed with the first, second, and third attachment arms 250, 260, 270, such that the first retaining arm 280 is positioned between the first and second attachment arms 250, 260 and the second retaining arm 290 is positioned between the second and third attachment arms 260, 270. However, it will be understood that such positioning is not limiting and that the attachment arms 250, 260, 270 and the retaining arms 280, 290 can be arranged in any suitable layout or configuration along the body 242.

Figure 6:
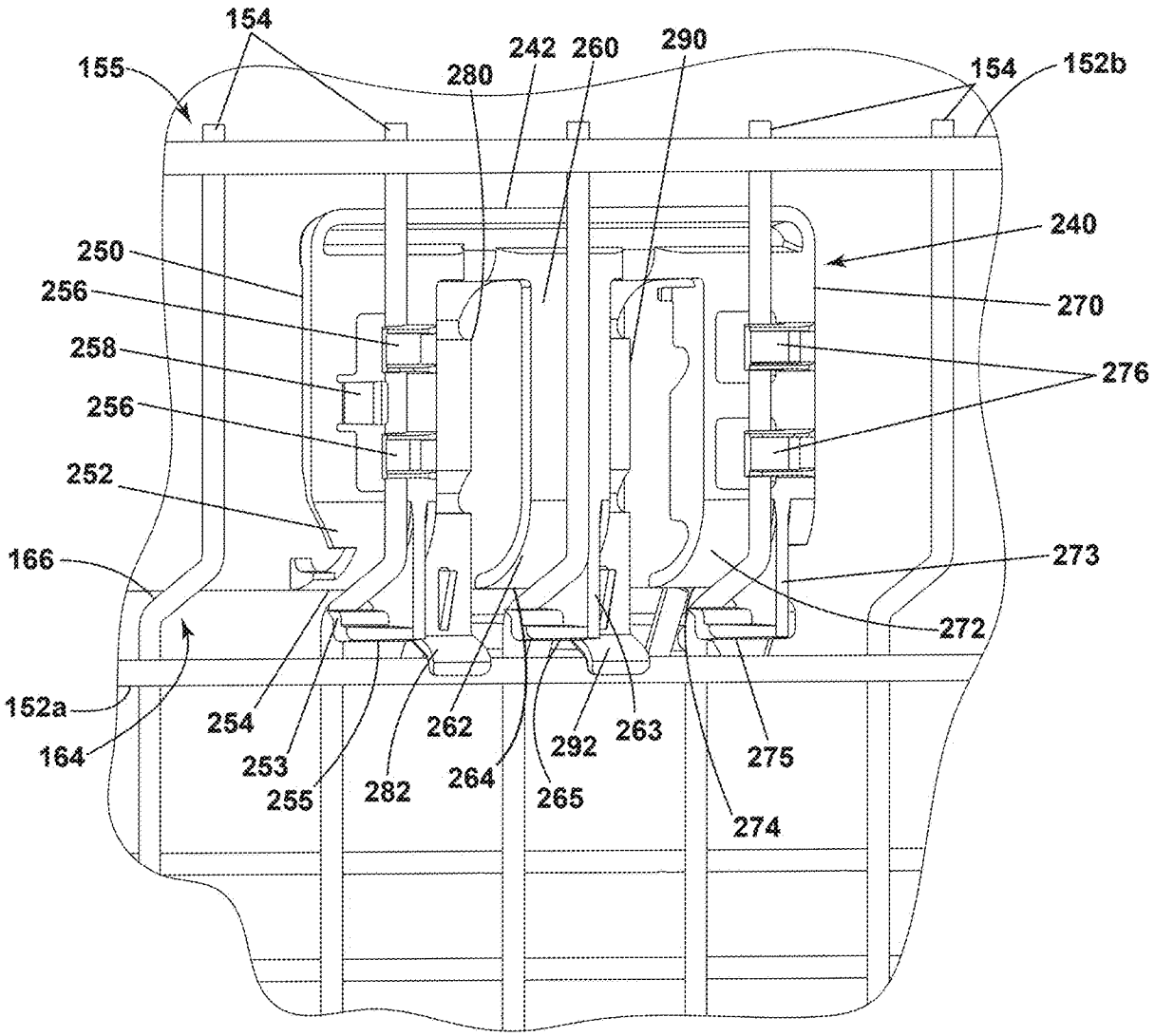
FIG. 6 illustrates an enlarged side perspective view of a portion of the dish rack assembly and the retaining member of the moveable shelf assembly of FIG. 4, with the shelf body removed.

Turning now to the enlarged view of the portion of the dish rack assembly 120 illustrated in FIG. 6, the shelf body 210 of the moveable shelf assembly 200 is removed to better show the attachment of the retaining member 240 to the side wall 155. Referring first to the side wall 155 in greater detail, the plurality of cross members 152 (FIG. 4) can be thought of more specifically as comprising a lower cross member 152*a* and an upper cross member 152*b*. Further, it is illustrated that each of the vertical members 154 of the side wall 155 comprises a contoured portion 164 defining a non-vertical section 166 of the otherwise vertical member 154. The non-vertical sections 166 extend laterally inward from the vertical members 154 of the side wall 155, toward or into the interior 158 (FIG. 4). The non-vertical sections 166 of the vertical members 154 can be positioned above the lower cross member 152*a* and below the upper cross member 152*b*.

The attachment of the first, second, and third attachment arms 250, 260, 270 with the vertical members 154 includes positioning of the lower curved ends 252, 262, 272 relative to the non-vertical sections 166 of the vertical members 154. By way of non-limiting example, the lower curved ends 252, 262, 272 have a degree or angle of curvature that is generally complementary with the angle of the non-vertical sections 166 of the vertical members 154, such that the lower curved ends 252, 262, 272 extend above and along the non-vertical sections 166, and, optionally, can at least partially rest on the non-vertical sections 166. Specifically, the guide flanges 253, 263, 273, together with the lower curved ends 252, 262, 272, at least partially define the guide slots 254, 264, 274 within which a portion of the non-vertical sections 166 can be received. By way of non-limiting example, the non-vertical sections 166 can be snap fit or have an interference fit within the guide slots 254, 264, 274, or the non-vertical sections 166 can be aligned within or loosely received within the guide slots 254, 264, 274, but not in frictional engagement within the guide slots 254, 264, 274.

As illustrated, the positioning of the mounting clips 256 and the opposing clip 258 to retain the first attachment arm 250 about the vertical member 154 is configured to prevent forward and rearward motion of the retaining member 240 relative to the vertical member 154. Further by way of non-limiting example, it is contemplated that the mounting clips 256, 276 can be snap fit or have an interference fit with the vertical members 154, or the mounting clips 256, 276 can serve only to align with or to loosely receive the vertical members 154, with frictional engagement with the vertical members 154 achieved only by cooperation of the mounting clips 256, 276 with opposing clips 258.

The first and second retaining arms 280, 290 can be specifically configured for coupling with the lower cross member 152*a* of the side wall 155. Further, the lower retaining ends 282, 292 of the first and second retaining arms 280, 290 can specifically align with or engage with the lower cross member 152*a* of the side wall 155. By way of non-limiting example, the lower retaining ends 282, 292 can be snap fit or have an interference fit or other frictional engagement with the lower cross member 152*a*, or the lower retaining ends 282, 292 can simply align with or rest upon the lower cross member 152*a* by gravity.

Figure 7:
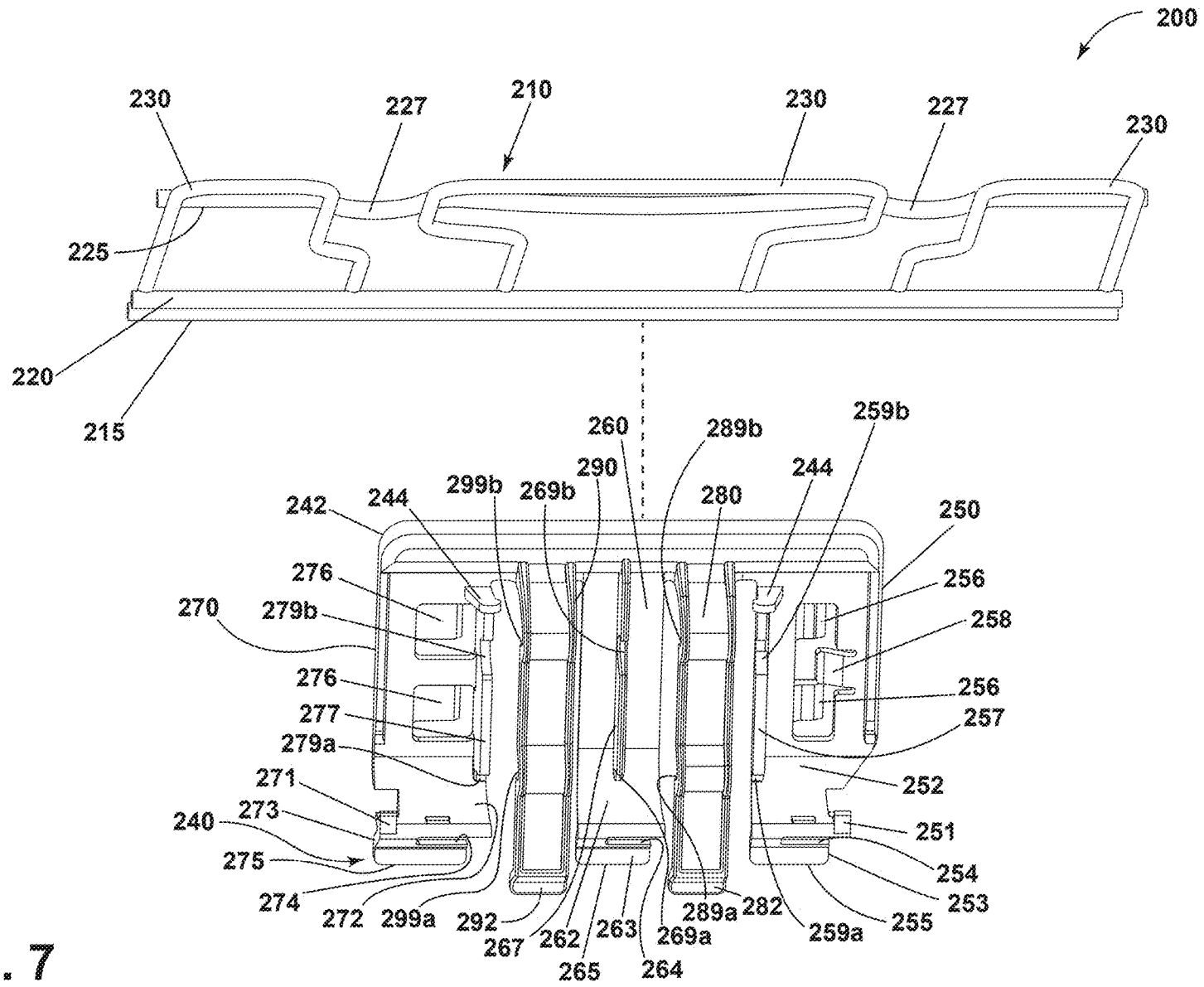
FIG. 7 illustrates an exploded front perspective view of the moveable shelf assembly of FIG. 4, shown with the shelf body in the use position and with the dish rack assembly removed.

Turning now to FIG. 7, the front of the moveable shelf assembly 200 is shown with the dish rack assembly 120 removed and the shelf body 210 exploded from the retaining member 240 to better show the detail of the shelf body 210 and the retaining member 240. The shelf body 210 is provided as a generally planar shelf body 210 comprising at least one positioning cross bar 215 defining a width of the shelf body 210 and configured for movably coupling with the retaining member 240. As illustrated, the shelf body 210 comprises a first positioning cross bar 215 and a second positioning cross bar 220 spaced slightly apart and extending parallel with one another. While the first and second positioning cross bars 215, 220 are illustrated herein as being coextensive in length and width, it will be understood that this is not limiting and the first and second positioning cross bars 215, 220 can have different lengths and/or widths.

At least one dish support 230, illustrated herein as a plurality of dish supports 230, extends from the first and second positioning cross bars 215, 220 to further define the shelf body 210, which can, by way of non-limiting example, form a grid-like of varying pattern configured to support small dish items to be treated when the shelf body 210 is in the deployed or use position and configured to allow liquid to pass through the shelf body 210 during a treating cycle of operation. The shelf body 210 further comprises at least one cross member 225 spanning the dish supports 230 and spaced from the first and second positioning cross bars 215, 220. The cross member 225 can define at least one detent 227 along the length of the cross member 225, such that, when the shelf body 210 is in the use position, each detent 227 can accommodate and retain small dish items, such as, but not limited to, stemmed glassware, bottle tops, or small kitchen utensils.

At least one of the first, second, and third attachment arms 250, 260, 270 can include additional structures for coupling or engagement of the retaining member 240 with the shelf body 210. In the illustrated example, the first attachment arm 250 and the third attachment arm 270 each further comprises at least one retaining clip 244 extending laterally inward from the first and third attachment arms 250, 270, respectively, toward or into the interior 158 (FIG. 4), and configured for selectively receiving a portion of the shelf body 210, such as a portion of the dish support 230, when the shelf body 210 is in the storage position (shown in FIG. 10). While the first and third attachment arms 250, 270 are illustrated as comprising at least one retaining clip 244, it will be understood that such positions of the retaining clips 244 are not limiting, and that any of the first, second, and/or third attachment arms 250, 260, 270 can include any suitable distribution or number of retaining clips 244, and/or the retaining clips 244 can extend from the body 242 itself or from any other suitable portion of the retaining member 240. Further by way of non-limiting example, it is contemplated that the retaining clips 244 can be configured for a snap fit or an interference fit with the shelf body 210, or the retaining clips 244 can receive the portion of the shelf body 210 without frictional engagement.

Figure 10:
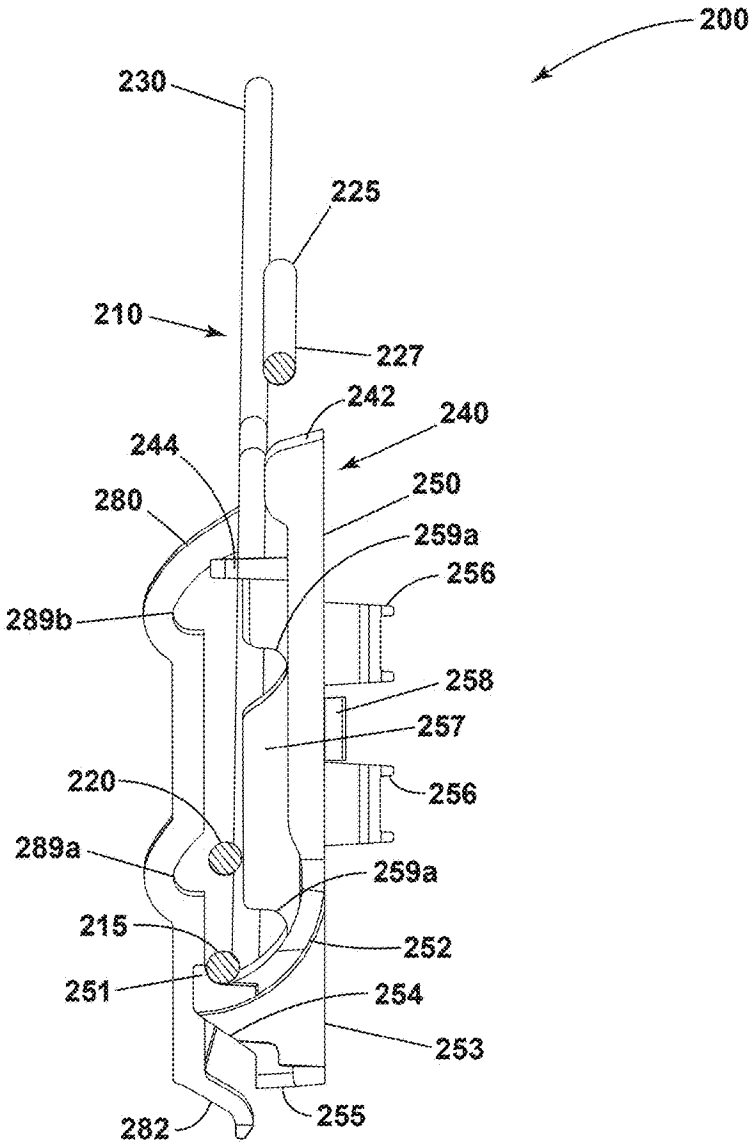
FIG. 10 illustrates another front cross-sectional view of the moveable shelf assembly of FIG. 7, with the shelf body shown in a third, storage position.

In a further illustrated example, each of the first and third attachment arms 250, 270 further comprise at least one retaining rib 251, 271 extending substantially upward from the lower curved ends 252, 272, away from the guide flanges 253, 273, and configured for selectively receiving a portion of the shelf body 210, such as a portion of the first positioning cross bar 215 when the shelf body 210 is in the storage position (shown in FIG. 10). It will be understood that such positions of the retaining ribs 251, 271 are not limiting and that any of the first, second, and third attachment arms 250, 260, 270 can include any suitable distribution of retaining ribs 251, 271. By way of non-limiting example, it is contemplated that the retaining ribs 251, 271 can be configured for an interference fit or other frictional engagement with the shelf body 210, or the first positioning cross bar 215 can simply align with or rest against the retaining ribs 251, 271 by gravity.

Each of the first, second, and third attachment arms 250, 260, 270 further comprises a positioning rib 257, 267, 277, extending laterally inward from the first, second, and third attachment arms 250, 260, 270, toward or into the interior 158 (FIG. 4), and configured to selectively retain at least a portion of the shelf body 210 when the shelf body 210 is provided in one or more use positions. For example, each of the positioning ribs 257, 267, 277 defines a first or lower positioning detent 259*a*, 269*a*, 279*a* and a second or upper positioning detent 259*b*, 269*b*, 279*b* extending laterally outwardly into the surface of the positioning ribs 257, 267, 277, away from the interior 158 (FIG. 4), and configured to selectively retain a portion of the first positioning cross bar 215 when the shelf body 210 is provided in one or more use positions, as will be shown and described in more detail below. By way of non-limiting example, it is contemplated that the positioning detents 259*a*, 259*b*, 269*a*, 269*b*, 279*a*, 279*b* can be configured for an interference fit or other frictional engagement with the first positioning cross bar 215, or the first positioning cross bar 215 can simply rest or bear against the positioning detents 259*a*, 259*b*, 269*a*, 269*b*, 279*a*, 279*b*.

Similarly, each of the first and second retaining arms 280, 290 are configured for moveable coupling with the shelf body 210 and include additional structures or features for coupling with the shelf body 210. In the illustrated example, each of the first and second retaining arms 280, 290 defines a first or lower positioning detent 289*a*, 299*a* and a second or upper positioning detent 289*b*, 299*b* extending laterally inwardly into the surface of the first and second retaining arms 280, 290, toward or into the interior 158 (FIG. 4), and configured to selectively retain a portion of the second positioning cross bar 220 when the shelf body 210 is provided in one or more use positions, as will be shown and described in more detail below. By way of non-limiting example, it is contemplated that the positioning detents 289*a*, 289*b*, 299*a*, 299*b* can be configured for an interference fit or other frictional engagement with the second positioning cross bar 220, or the second positioning cross bar 220 can simply rest or bear against the positioning detents 289*a*, 289*b*, 299*a*, 299*b*.

Figure 8:
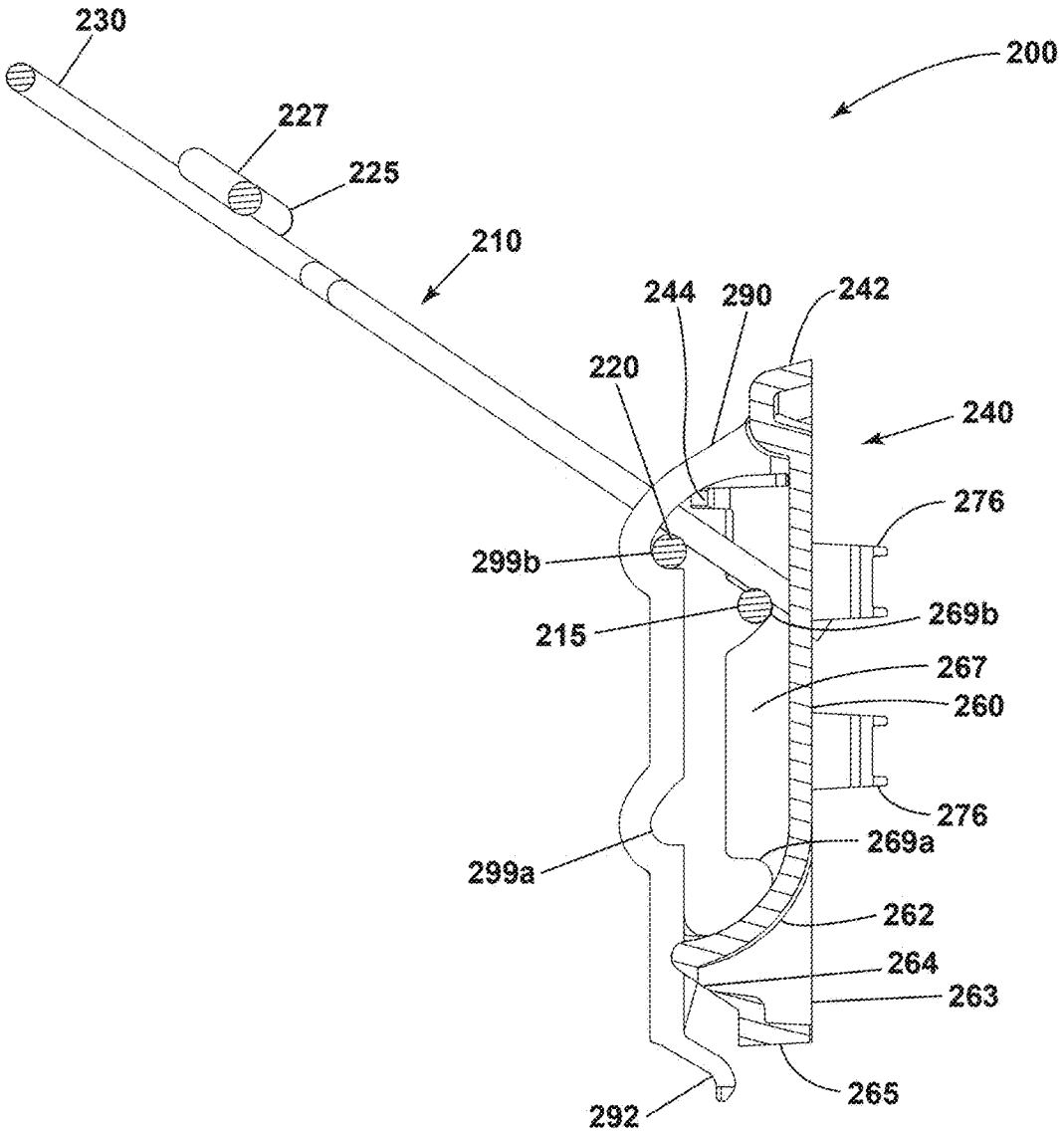
FIG. 8 illustrates a front cross-sectional view of the moveable shelf assembly of FIG. 7, with the shelf body shown in a first, or upper, use position.

Turning now to FIG. 8, the moveable shelf assembly 200 is shown with the shelf body 210 in a first, or upper, use position relative to the retaining member 240. In the upper use position, the shelf body 210 is provided in a non-vertical position and is at least partially folded down for use in supporting dish items to be treated. With the shelf body 210 provided at the illustrated angle, corresponding with the upper use position, the first positioning cross bar 215 is received within the upper positioning detent 269*b* of the positioning rib 267 on the second attachment arm 260, while the second positioning cross bar 220 is received within the upper positioning detent 299*b* of the second retaining arm 290. In this upper use position, the first positioning cross bar 215 bears generally upwardly within the upper positioning detent 269*b*, while the second positioning cross bar 220 bear generally downwardly within the upper positioning detent 299*b*, such that the opposing forces serve to retain the shelf body 210 in the upper use position.

While the view of FIG. 8 shows the first positioning cross bar 215 bearing upwardly within the upper positioning detent 269*b* and the second positioning cross bar 220 bearing downwardly within the upper positioning detent 299*b* to retain the shelf body 210 in the upper use position, it will be understood that, at the same time, likewise the first positioning cross bar 215 also bears upwardly within the upper positioning detents 259*b*, 279*b* of the positioning ribs 257, 277 on the first and third attachment arms 250, 270, while the second positioning cross bar 220 also bears downwardly within the upper positioning detent 289*b* of the first retaining arm 280, to similarly serve to retain the shelf body 210 in the upper use position.

Turning now to FIG. 9, the moveable shelf assembly 200 is shown with the shelf body 210 in a second, or lower, use position relative to the retaining member 240. In the lower use position, the shelf body 210 is provided in a non-vertical position and is at least partially folded down for use in supporting dish items to be treated. With the shelf body 210 provided at the illustrated angle, corresponding with the lower use position, the first positioning cross bar 215 is received within the lower positioning detent 269*a* of the positioning rib 267 on the second attachment arm 260, while the second positioning cross bar 220 is received within the lower positioning detent 299*a* of the second retaining arm 290. In this lower use position, the first positioning cross bar 215 bears generally upwardly within the lower positioning detent 269*a*, while the second positioning cross bar 220 bear generally downwardly within the lower positioning detent 299*a*, such that the opposing forces serve to retain the shelf body 210 in the lower use position.

While the view of FIG. 9 shows the first positioning cross bar 215 bearing upwardly within the lower positioning detent 269*a* and the second positioning cross bar 220 bearing downwardly within the lower positioning detent 299*a* to retain the shelf body 210 in the lower use position, it will be understood that, at the same time, likewise the first positioning cross bar 215 also bears upwardly within the lower positioning detents 259*a*, 279*a* of the positioning ribs 257, 277 on the first and third attachment arms 250, 270, while the second positioning cross bar 220 also bears downwardly within the lower positioning detent 289*a* of the first retaining arm 280, to similarly serve to retain the shelf body 210 in the lower use position.

Turning now to FIG. 10, the moveable shelf assembly 200 is shown with the shelf body 210 in a third, or storage, position relative to the retaining member 240. In the storage position, the shelf body 210 is provided in a substantially vertical position and is not folded down for use in supporting dish items to be treated, but rather is folded up against the side wall 155 so as to not impede the space within the interior 158 (FIG. 4). With the shelf body 210 provided at the illustrated vertical angle, corresponding with the storage position, the first positioning cross bar 215 is received or leans against the retaining rib 251 of the lower retaining end 252 on the first attachment arm 250, while the second positioning cross bar 220 is received or leans against the positioning rib 257 of the first attachment arm 250, but not within either of the positioning detents 259*a*, 259*b*. In this storage position, the first positioning cross bar 215 bears generally laterally inwardly against the retaining rib 251, while the second positioning cross bar 220 bear generally laterally outwardly against the positioning rib 257, such that the opposing forces serve to at least partially retain the shelf body 210 in the storage position. Additionally, with the shelf body 210 in the illustrated storage position, a portion of the shelf body 210, illustrated herein as a portion of one of the dish supports 230, is received within or against the retaining clip 244 of the first attachment arm 250, such that the portion of the one of the dish supports 230 bears generally laterally inwardly against the retaining clip 244 and the retaining clip 244 further serves to at least partially retain the shelf body 210 in the storage position. Optionally, the retaining clip 244 can engage the portion of the one of the dish supports 230 in a snap fit, an interference fit, or other type of frictional engagement, in order to at least partially retain the dish support 230 and the shelf body 210 in the storage position.

While the view of FIG. 10 shows the first positioning cross bar 215 bearing laterally inwardly against the retaining rib 251, the second positioning cross bar 220 bearing laterally outwardly against the positioning rib 257, and one of the dish supports 230 bearing laterally inwardly against the retaining clip 244 of the first attachment arm 250 to retain the shelf body 210 in the storage position, it will be understood that, at the same time, likewise the first positioning cross bar 215 also bears laterally inwardly against the retaining rib 271 of the lower retaining end 272 on the third attachment arm 270, while the second positioning cross bar 220 also bears laterally outwardly against the positioning ribs 267, 277 of the second and third attachment arms 260, 270, and while one of the dish supports 230 also bears laterally inwardly against the retaining clip 244 of the third attachment arm 270, to similarly serve to retain the shelf body 210 in the storage position.

Turning now to the operation of the moveable shelf assembly 200, when the moveable shelf assembly 200 is in the storage position of FIG. 10 and a user wishes to use the shelf body 210 for supporting dish items, the user can simply grasp the shelf body 210, disengage the dish supports 230 from the retaining clips 244, and rotate the shelf body 210 counter-clockwise to move the first positioning cross bar 215 out of engagement with the retaining ribs 251, 271 and into engagement with the lower positioning detents 259*a*, 269*a*, 279*a* and to move the second positioning cross bar 220 out of engagement with the positioning ribs 257, 267, 277 and into engagement with the lower positioning detents 289*a*, 299*a*, in order to move the shelf body 210 from the storage position of FIG. 10 into the lower use position of FIG. 9.

If the user desires to raise the shelf body 210 from the lower use position of FIG. 9 to the upper use position of FIG. 8 to vertically adjust the use position of the shelf body 210, the user can simply reverse the previous action by rotating the shelf body 210 clockwise to move the first positioning cross bar 215 out of engagement with the lower positioning detents 259*a*, 269*a*, 279*a* and to move the second positioning cross bar 220 out of engagement with the lower positioning detents 289*a*, 299*a*, in order to move the shelf body 210 from the lower use position of FIG. 9 into the generally vertical orientation of the storage position of FIG. 10, but without the dish supports 230 engaged with the retaining clips 244. Once the shelf body 210 is returned to this generally vertical orientation of the storage position, the user can raise the shelf body 210 by sliding the shelf body 210 vertically upwards, remaining in the vertical orientation, until the first and second positioning cross bars 215, 220 are generally vertically aligned with the upper positioning detents 259*b*, 269*b*, 279*b* and 289*b*, 299*b*, respectively. At that point, by continuing to grasp the shelf body 210, the user can rotate the shelf body 210 counter-clockwise once more, to move the first positioning cross bar 215 into engagement with the upper positioning detents 259*b*, 269*b*, 279*b* and to move the second positioning cross bar 220 into engagement with the upper positioning detents 289*b*, 299*b*, in order to move the shelf body 210 from the generally vertical orientation into the upper use position of FIG. 8, thus completing the movement of the shelf body 210 from the lower use position of FIG. 9 to the upper use position of FIG. 8. Similarly, this sequence of movements can be reversed to lower the shelf body 210 from the upper use position of FIG. 8 to the lower use position of FIG. 9 to vertically lower the use position of the shelf body 210.

If the user desires to return the shelf body 210 from the upper use position of FIG. 8 to the storage position of FIG. 10, the user can simply reverse the previous action by rotating the shelf body 210 clockwise to move the first positioning cross bar 215 out of engagement with the upper positioning detents 259*b*, 269*b*, 279*b* and to move the second positioning cross bar 220 out of engagement with the upper positioning detents 289*b*, 299*b*, in order to move the shelf body 210 from the upper use position of FIG. 8 into a generally vertical orientation, similar to the storage position of FIG. 10, but without the dish supports 230 engaged with the retaining clips 244 and with the shelf body 210 vertically raised within the retaining member 240 relative to the storage position of FIG. 10. Once the shelf body 210 is returned to this generally vertical orientation, the user can lower the shelf body 210 by sliding the shelf body 210 vertically downwards, remaining in the vertical orientation, until the first positioning cross bar 215 is generally vertically aligned with the retaining ribs 251, 271. At that point, the user can engage the dish supports 230 with the retaining clips 244 once more, to move the first positioning cross bar 215 into engagement with the retaining ribs 251, 271 and to move the second positioning cross bar 220 into engagement with the positioning ribs 257, 267, 277, in order to move the shelf body 210 from the generally vertical orientation into the storage position of FIG. 10, thus completing the movement of the shelf body 210 from the upper use position of FIG. 8 to the storage position of FIG. 10.

The aspects of the present disclosure described herein set forth a moveable shelf assembly that can be used within a dish rack for easy customization of the treating area to accommodate specific types of dish items as desired by a user. Such a moveable shelf assembly can be stored in a compact position when not in use, and can occupy more than one use position for further customization by adjusting a vertical position of the shelf when in use. The moveable shelf assembly can be provided within a dish rack of a dish treating appliance in its manufacture. Alternatively, the moveable shelf assembly can be provided as a standalone kit that can be retrofit to a variety of existing dish racks and dish treating appliances with wide applicability.

It will also be understood that various changes and/or modifications can be made without departing from the spirit of the present disclosure. By way of non-limiting example, although the present disclosure is described for use with a wire dish rack, it will be recognized that the moveable shelf assembly can be employed with various rack constructions, including, but not limited to, coated wire racks, uncoated wire racks, molded racks, such as racks molded of plastic, or metal racks.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A moveable shelf assembly, comprising:

a retaining body having a first attachment arm, a second attachment arm, and at least one retaining arm configured to be coupled to a dish rack; and a planar shelf body extending along a width and operably coupled to the retaining body for rotation between a storage position wherein the shelf body is upright and a use position wherein the shelf body is at least partially lowered, wherein the shelf body includes first and second positioning cross bars extending along the width and configured to allow for vertical movement of the shelf body along the retaining body between at least a lower use position and an upper use position;

wherein the first attachment arm is configured to be coupled to at least one of a plurality of cross members of the dish rack, wherein the second attachment arm is configured to be coupled to at least one of a plurality of vertical members of the dish rack; and wherein the at least one retaining arm is positioned between the first attachment arm and the second attachment arm.

2. The moveable shelf assembly of claim 1, wherein the retaining body further comprises at least one retaining rib configured to bear against the first positioning cross bar for retaining the shelf body in the storage position.

3. The moveable shelf assembly of claim 2, wherein the retaining body further comprises at least one retaining clip configured to at least partially receive a portion of the shelf body for retaining the shelf body in the storage position.

4. The moveable shelf assembly of claim 1, wherein the retaining body further comprises a set of lower positioning detents for retaining the first and second positioning cross bars of the shelf body in the lower use position.

5. The moveable shelf assembly of claim 4, wherein the retaining body further comprises a set of upper positioning detents for retaining the first and second positioning cross bars of the shelf body in the upper use position.

6. The moveable shelf assembly of claim 1, wherein the shelf body is rotatable about the first positioning cross bar and relative to the retaining body between the storage position and the use positions.

7. The moveable shelf assembly of claim 6, wherein the shelf body is rotatable about the first positioning cross bar to a vertical position relative to the retaining body.

8. The moveable shelf assembly of claim 6, wherein the shelf body can be vertically slid between a height for the lower use position and a height for the upper use position when the shelf body is in the storage position.

9. The moveable shelf assembly of claim 1, wherein the moveable shelf assembly is configured to be provided within a perimeter wall of a dish rack assembly having a bottom wall and wherein the perimeter wall extends upwardly from the bottom wall and at least partially defines an interior of the dish rack assembly.

10. The moveable shelf assembly of claim 9, wherein the perimeter wall comprises a plurality of cross members and a plurality of vertical members.

11. The moveable shelf assembly of claim 10, wherein each vertical member of the plurality of vertical members comprises a contoured portion defining a non-vertical section.

12. The moveable shelf assembly of claim 11, wherein the non-vertical sections extend laterally inward from the vertical members of the perimeter wall.

13. The moveable shelf assembly of claim 11, wherein the at least one attachment arm is coupled to the non-vertical section of the at least one of the plurality of vertical members.

14. The moveable shelf assembly of claim 10, wherein the plurality of cross members comprises a lower cross member and an upper cross member.

15. The moveable shelf assembly of claim 14, wherein each vertical member of the plurality of vertical members comprises a contoured portion defining a non-vertical section, and wherein the non-vertical sections of the vertical members are positioned above the lower cross member and below the upper cross member.

16. The moveable shelf assembly of claim 15, wherein the at least one attachment arm is coupled to the lower cross member.

17. A retrofit kit for a dish treating appliance, the retrofit kit comprising a moveable shelf assembly, comprising:

a retaining body having at least one attachment arm and at least one retaining arm extending downwardly from the retaining body, the at least one attachment arm and the at least one retaining arm configured to be coupled to a dish rack; and a planar shelf body extending along a width and operably coupled to the retaining body for rotation between a storage position wherein the shelf body is upright and a use position wherein the shelf body is at least partially lowered, wherein the shelf body includes first and second positioning cross bars extending along the width and configured to allow for vertical movement of the shelf body along the retaining body between at least a lower use position and an upper use position;

wherein the at least one attachment arm includes a first positioning detent configured to selectively retain a portion of the second positioning cross bar, and the at least one retaining arm includes a second positioning detent configured to selectivity retain a portion of the first positioning cross bar;

wherein the first positioning cross bar bears generally upwardly within the second positioning detent of the retaining arm and the second positioning cross bar bears generally downwardly within the first positioning detent of the attachment arm such that opposing forces retain the shelf body in the upper use position and the lower use position.

18. The retrofit kit of claim 17, wherein the retaining body further comprises a set of lower positioning detents for retaining the first and second positioning cross bars of the shelf body in the lower use position and a set of upper positioning detents for retaining the first and second positioning cross bars of the shelf body in the upper use position.

19. The moveable shelf assembly of claim 1, wherein the at least one attachment arm includes a first positioning detent configured to selectively retain a portion of the second positioning cross bar, and the at least one retaining arm includes a second positioning detent configured to selectively retain a portion of the first positioning cross bar, wherein the first positioning cross bar bears generally upwardly within the second positioning detent of the retaining arm and the second positioning cross bar bears generally downwardly within the first positioning detent of the attachment arm such that opposing forces retain the shelf body in the upper use position and the lower use position.

* * * * *